United States Patent [19]

Bayh, III et al.

[11] 4,425,965

[45] Jan. 17, 1984

[54] SAFETY SYSTEM FOR SUBMERSIBLE PUMP

[75] Inventors: Russell I. Bayh, III, Carrollton; William G. Boyle, Dallas, both of Tex.

[73] Assignee: Otis Engineering Corporation, Dallas, Tex.

[21] Appl. No.: 386,035

[22] Filed: Jun. 7, 1982

[51] Int. Cl.[3] ..... E21B 43/00; E21B 34/06; F16L 39/00

[52] U.S. Cl. ..... 166/106; 166/319; 417/424; 285/264

[58] Field of Search ..... 166/106, 105, 70, 319–324, 166/373, 374, 381, 382, 386; 417/424; 285/264, 261

[56] References Cited

U.S. PATENT DOCUMENTS

| | | | |
|---|---|---|---|
| 2,266,383 | 12/1941 | Quintrell | 285/264 X |
| 3,208,531 | 9/1965 | Tamplen | 166/125 |
| 3,236,544 | 2/1966 | Brown | 285/97 |
| 3,663,043 | 5/1972 | Walton | 285/264 X |
| 3,853,430 | 12/1974 | O'Rourke | 417/360 |
| 4,121,659 | 10/1974 | Taylor | 166/129 |
| 4,134,454 | 1/1979 | Taylor | 166/320 |
| 4,361,188 | 11/1982 | Russell | 166/381 |

*Primary Examiner*—Ernest R. Purser
*Assistant Examiner*—Thuy M. Bui
*Attorney, Agent, or Firm*—Thomas R. Felger

[57] ABSTRACT

A submersible pump and safety system for installation in wells having a submersible pump adapted to land within a well flow conductor for pumping well fluids to the surface plus a subsurface safety valve or valves for maintaining the well under control as the pump is run into and removed from the well. The subsurface safety valve is hydraulically actuated by the discharge pressure of the pump. The landing nipple in which the pump and safety valve are mounted has longitudinal flow passageways to communicate pump discharge pressure to the safety valve. The landing nipple and longitudinal flow passageways are designed for improved reliability and minimize the possibility of mechanical damage interrupting control fluid flow to the safety valve.

12 Claims, 23 Drawing Figures

SAFETY SYSTEM FOR SUBMERSIBLE PUMP

BACKGROUND OF THE INVENTION

1. Field of the Invention

This invention relates to submersible pump installations for wells and to a safety system which maintains the well under control. The invention also relates to a novel system to direct control fluid to the safety valve used in the safety system.

2. Description of the Prior Art

In some hydrocarbon producing formations, sufficient reservoir pressure may be present to cause formation fluids to flow to the well surface. However, the hydrocarbon flow resulting from the natural reservoir pressure may be significantly lower than the desired flow. For these types of wells, electrically powered submersible pumps are sometimes installed to achieve the desired hydrocarbon flow rate. Submersible pumps can be used to raise various liquids to the well surface. Examples of prior art submersible pump and safety valve installations are shown in U.S. Pat. Nos. 3,853,430; 4,121,659; 4,128,127 and 4,134,454. Copending U.S. Pat. Application Ser. No. 186,980 filed Sept. 15, 1980 also discloses an improved safety system for use with submersible pumps. The preceding patents and patent application are incorporated by reference for all purposes within this application.

BRIEF DESCRIPTION OF THE DRAWINGS

FIGS. 3A–K are drawings partially in section and partially in elevation showing the submersible pump and safety system of FIG. 1 disposed within a tubing string. The safety system is shown in its first or closed position blocking fluid flow through the tubing string.

SUMMARY OF THE INVENTION

Figure 1:
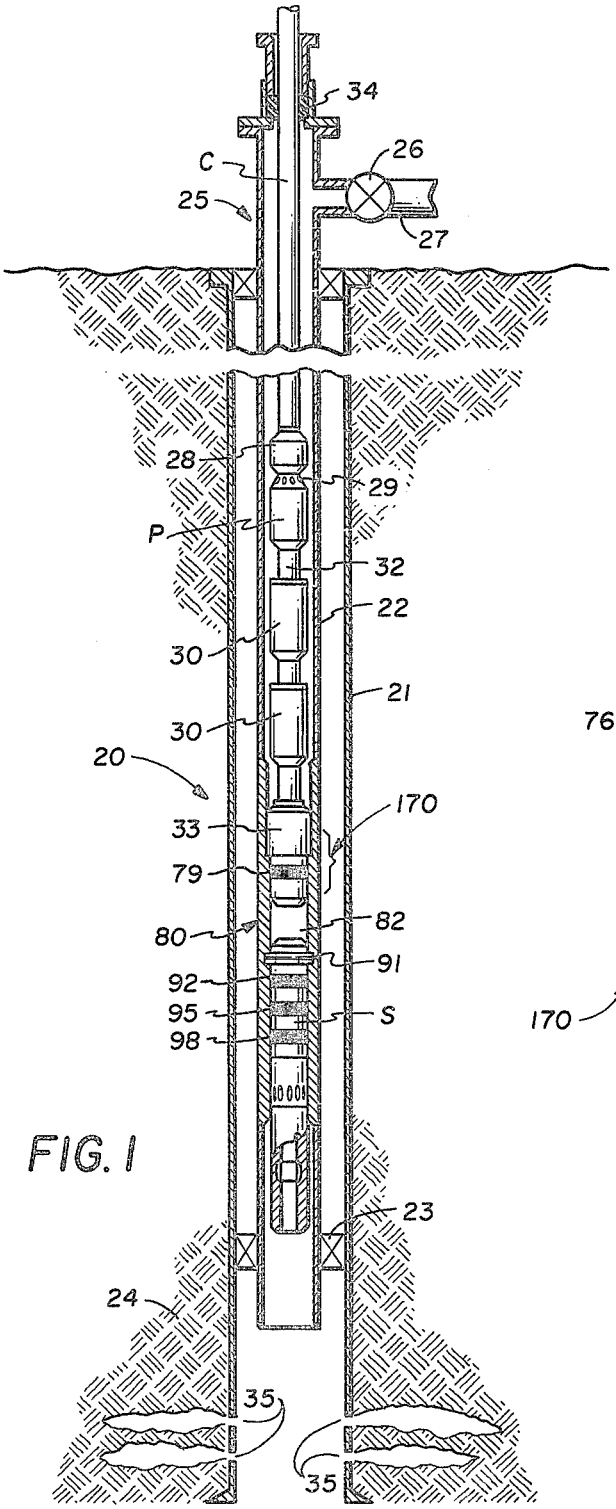
FIG. 1 is a schematic view partially in longitudinal section and partially in elevation showing a typical well completion with a submersible pump and the safety system of the present invention.
Figure 2:
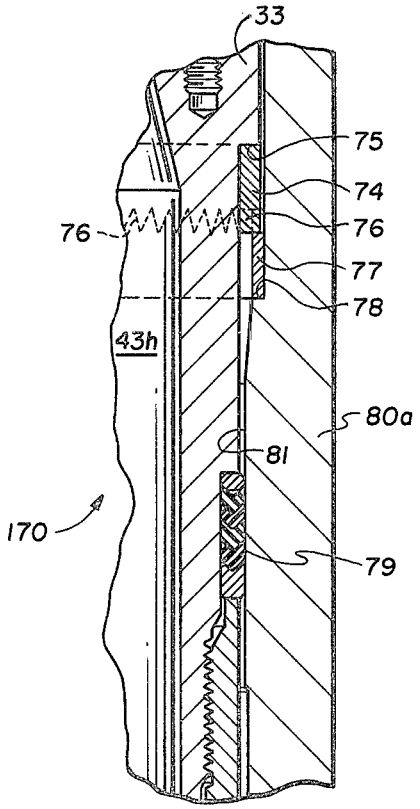
FIG. 2 is an enlarged drawing in longitudinal section with portions broken away showing the engagement between the pump seating mandrel and the pump landing nipple of FIG. 1.

The present invention discloses a safety system for a submersible pump disposed within a well flow conductor comprising a submersible pump having an intake and a discharge, means for mounting or installing the pump within the flow conductor at a preselected downhole location and for forming a fluid seal with the interior of the flow conductor to direct fluid flow through the pump, means for mounting or installing a subsurface safety valve within the flow conductor at a preselected downhole location below the submersible pump and for forming a seal between the exterior of the safety valve and the interior of the flow conductor, the safety valve having hydraulically actuated means for opening and closing the safety valve, a landing nipple with a main longitudinal bore therethrough comprising a portion of the flow conductor at a preselected downhole location, the landing nipple comprising a portion of the means for mounting the submersible pump and the safety valve within the flow conductor, a plurality of longitudinal flow passageways extending partially through the landing nipple and communicating with the main longitudinal bore at preselected locations, and at least one of the longitudinal flow passageways comprising means for conducting fluid pressure from the pump discharge to the hydraulically actuated means to open the safety valve.

One object of the invention is to provide a submersible pump installation having a safety system including a subsurface safety valve which is controlled by hydraulic pressure from the pump discharge.

Another object of the invention is to provide a landing nipple in which a submersible pump and a safety valve can be mounted or installed at a downhole location. The landing nipple includes longitudinal flow passageways, which are protected from mechanical damage, to communicate fluid pressure from the pump discharge to the safety valve.

A further object of the invention is to provide a submersible pump installation including a universal landing nipple in which various submersible pumps and safety valves can be mounted or installed.

A still further object of the invention is to provide swivel connectors which transmit torque from the submersible pump to the landing nipple to prevent rotation of the pump relative to the landing nipple when mounted therein. The swivel connectors are used to attach the pump to one or more accumulators and provide the required flexibility for installation and removal of the pump from the downhole location.

A significant advantage of the invention is that applicant's landing nipple, swivel connector means, and accumulator means allow selecting various commercially available pumps, pump locking mechanisms, and subsurface safety valves to design a completion best suited for the existing well conditions.

Additional objects and advantages of the invention will be readily apparent to those skilled in the art from reading the following description in conjunction with the drawings and claims.

DESCRIPTION OF THE PREFERRED EMBODIMENTS

A submersible pump installation and safety system incorporating the present invention are schematically illustrated in FIG. 1. Well 20 is partially defined by casing 21 which extends from wellhead 25 to producing formation 24. Tubing or well flow conductor 22 is disposed within casing 21 and extends downwardly from wellhead 25. Well packer 23 forms a fluid barier between tubing 22 and the interior of casing 21 to direct production fluid flow from formation 24 to the well surface via tubing 22. Valve 26 controls production fluid flow from wellhead 25 into surface flowline 27.

To increase production fluid flow, submersible pump P is shown installed within well flow conductor 22. Pump P is driven by electrical motor 28 to discharge formation fluids from outlets 29 into tubing 22. Accumulator means 30 are attached to and extend downwardly from pump inlet 32. Pump support means or seating mandrel 33 is attached to the lower accumulator means 30. The weight of pump P, motor 28, and accumulator means 30 is supported by the contact between seating mandrel 33 and well flow conductor 22 and partially by cable C. Cable C also supplies electrical power from the well surface to motor 28. Wellhead 25 includes packing means 34 which forms a fluid barier around cable C and prevents undesired fluid flow therepast. Pump P, motor 28, and cable C are commercially available from various companies. One such company is REDA Pump Division of TRW in Bartlesville, Okla.

Bore 43 extends longitudinally through pump inlet 32, swivel connector means 40, accumulator means 30, and pump seating mandrel 33. Bore 43 provides a flow path for formation fluids to enter pump P. Bore 43 is given an alphabetic designation within each component attached to pump P to aid in describing the invention. As shown in FIGS. 3A–3E, appropriately sized o-rings are included within each connection between the various components attached to pump P to prevent undesired fluid communication between bore 43 and the exterior of the components.

Safety valve S is releasable installed within well flow conductor 22 below submersible pump P. Safety valve S can be opened and closed to control the flow of well fluids into tubing 22 from producing formation 24. Pump P and its associated components are not directly attached to safety valve S. Therefore, pump P can be removed from its downhole location for maintenance and/or repair while safety valve S blocks undesired formation fluid flow through tubing 22 to the well surface. When the complete system is in operation, formation fluids flow into casing 21 through perforations 35. Packer 23 directs formation fluid flow into the lower end of tubing 22. Safety valve S in its second or open position allows formation fluids to flow upwardly through accumulator means 30 and inlet 32 into pump P. Formation fluids are then pumped to the well surface from discharge ports 29 via tubing 22.

Figure 3A:
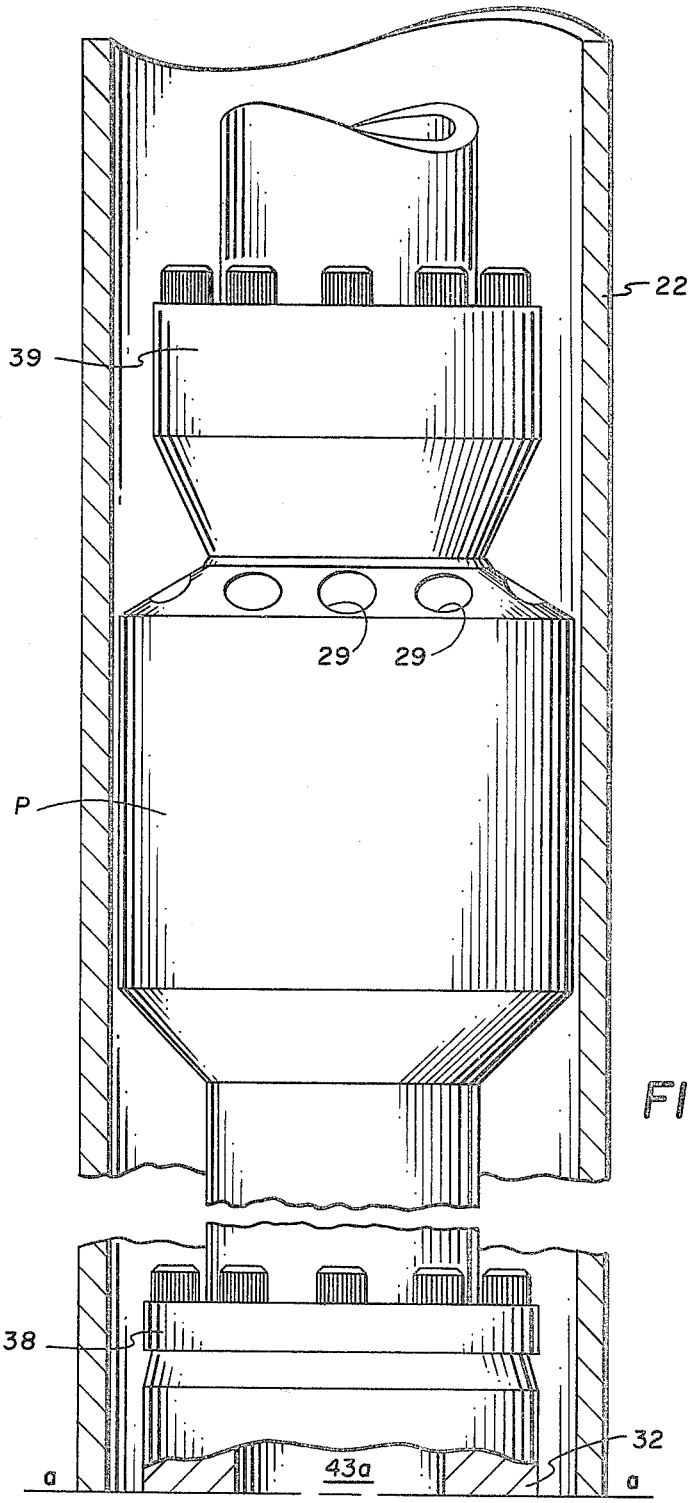

Pump P is attached to pump inlet 32 by bolted connection 38 as shown in FIG. 3A. One advantage of the present invention is that various submersible pumps can be attached to inlet 32 and satifactorily installed within tubing 22. Bolted connection 39 is used to attach electrical motor 28 (not shown in FIG. 3A) to pump P.

Figure 5:
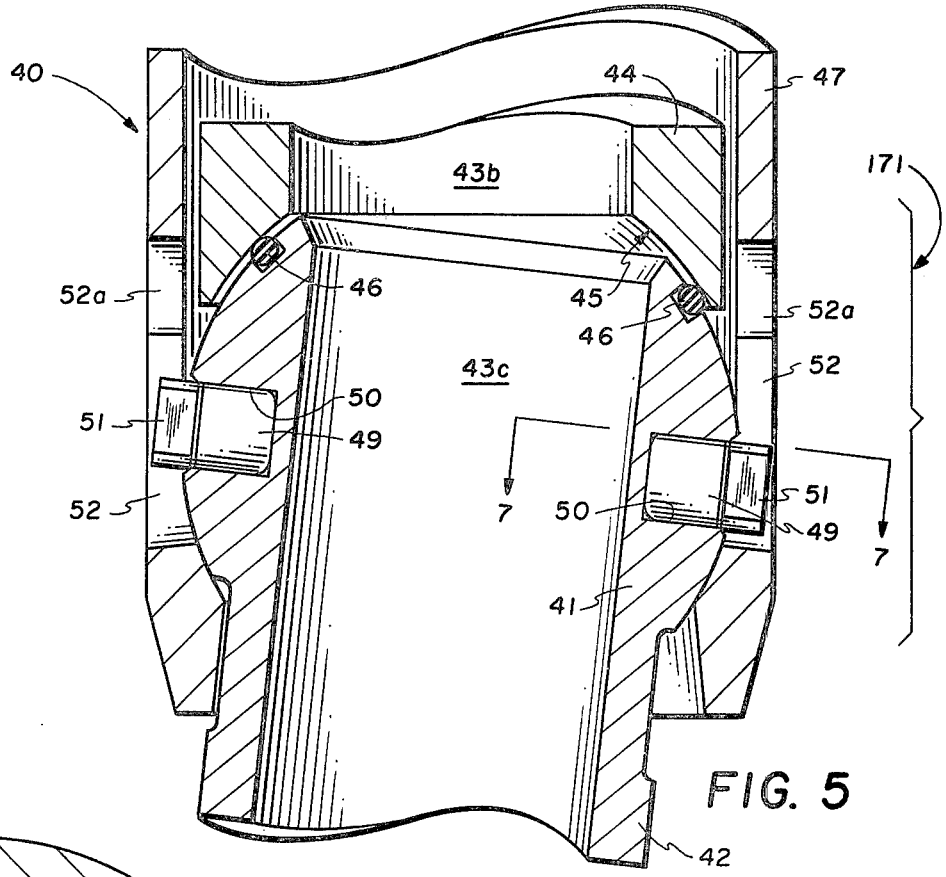
FIG. 5 is an enlarged drawing in longitudinal section with portions broken away showing a swivel connector means adapted for use with the submersible pump and safety system of FIG. 1.
Figure 7:
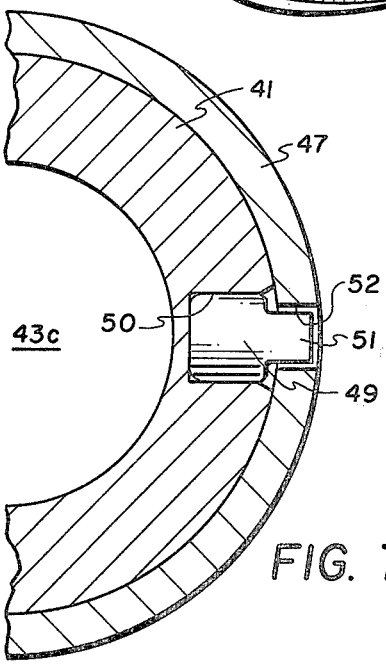
FIG. 7 is a drawing in horizontal section with portions broken away taken along line 7—7 of FIG. 5.
Figure 6:
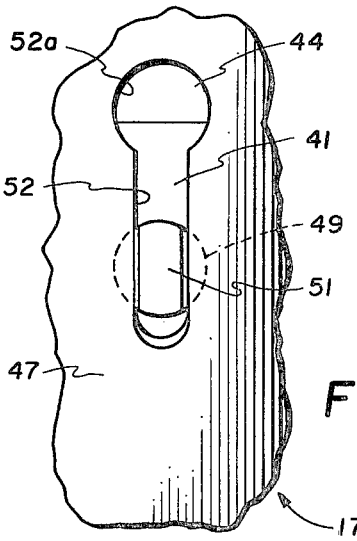
FIG. 6 is a drawing in elevation with portions broken away taken along line 171 of FIG. 5.
Figure 8:
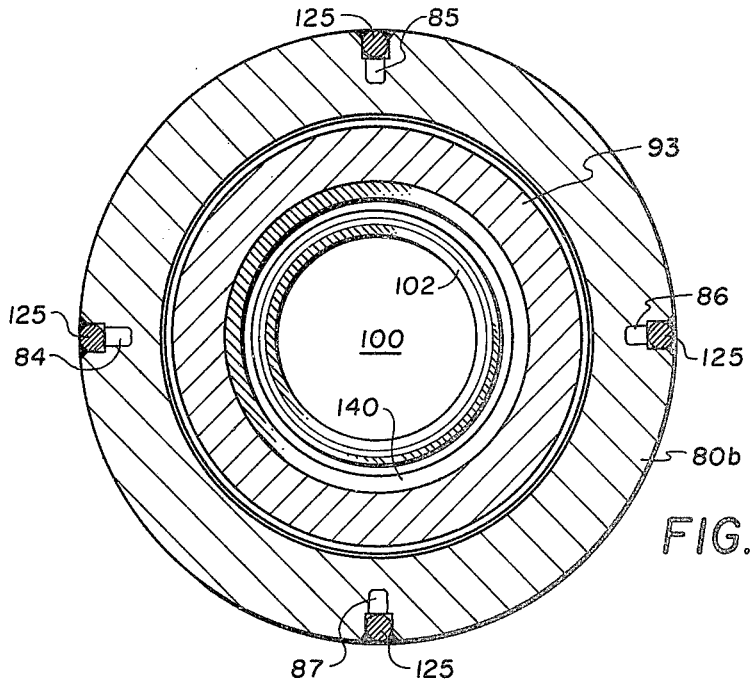
FIG. 8 is a drawing in horizontal section taken along line 8—8 of FIG. 3H.
Figure 9:
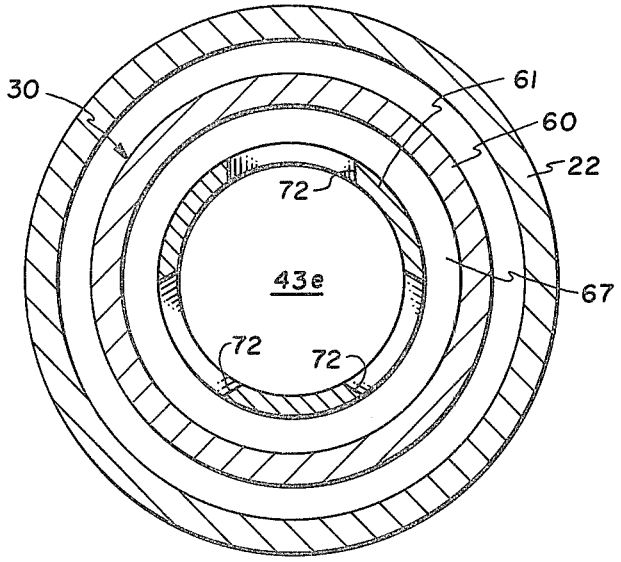
FIG. 9 is a drawing in horizontal section taken along line 9—9 of FIG. 3D.
Figure 10:
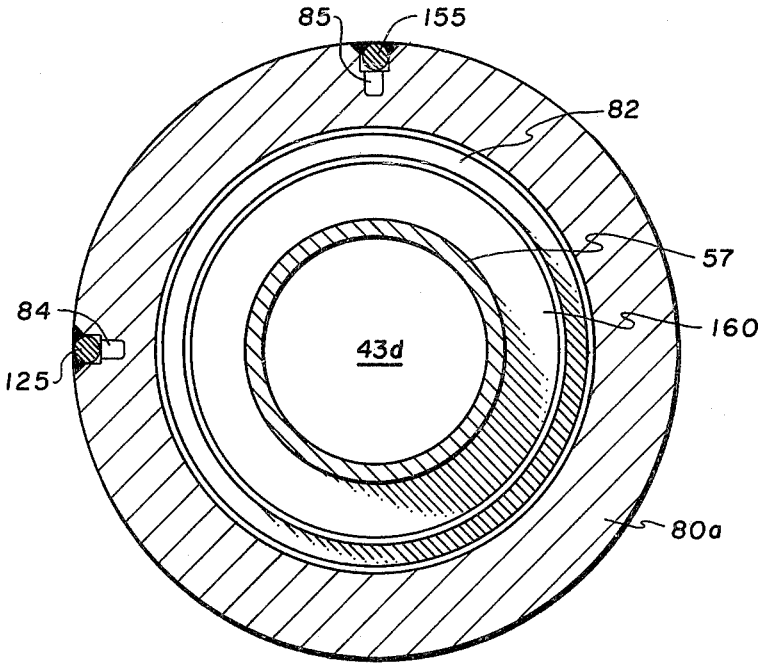
FIG. 10 is a drawing in horizontal section taken along line 10—10 of FIG. 3E.

The total length of the submersible pump installation including motor 28, pump P, accumulator means 30, and seating mandrel 33 requires the use of swivel connector means 40 between various components of the installation. Swivel connector means 40 compensate for deviations of tubing 22 while raising and lowering pump P and attached components. Swivel connector means 40 could also be classified as a flexible joint or articulated joint. Each swivel connector means 40 comprises a ball member 41 with tubular leg 42 extending longitudinally therefrom. One end of swivel cap 44 has concaved sealing surface 45 which abuts ball member 41. Sealing surface 45 has a radius compatible with the radius of ball member 41. O-ring 46 is carried in a groove in the exterior of ball member 41 to form a fluid seal with surface 45 as ball member 41 moves relative to cap 44. Bore 43 extends longitudinally through both ball member 41 and cap 44. Housing means 47 is fitted around ball member 41 and engaged by threads 48 to swivel cap 44. Tubular leg 42 extends through housing means 47. A pair of lugs 49 are positioned within holes 50 on opposite sides of ball member 41. A portion of each lug 49 extends radially from ball member 41 to provide keys 51. A pair of keyways 52 are machined diametrically opposite from each other through housing means 47. Keys 51 are sized to slide longitudinally with keyways 52 but prevent rotation of ball member 41 relative to housing means 47. Heavy duty set screws 53 are used to prevent rotation forces from loosening threads 48. For ease of manufacture and assembly, circular opening 52*a* is formed at one end of each keyway 52. The diameter of each opening 52*a* is selected to allow insertion of lug 49 therethrough and into its respective hole 50. Swivel connector means 40 allows longitudinal flexing, as shown in FIG. 5, of tubular leg 42 relative to swivel cap 44 in only one plane determined by the orientation of keys 51 and keyways 52. Thus, installing several swivel connector means 40 between the various components attached to pump P allows limited flexing of the components relative to each other while installing and retrieving pump P. However, swivel connector means 40 prevent rotation of the components attached thereto relative to each other.

Figure 3B:
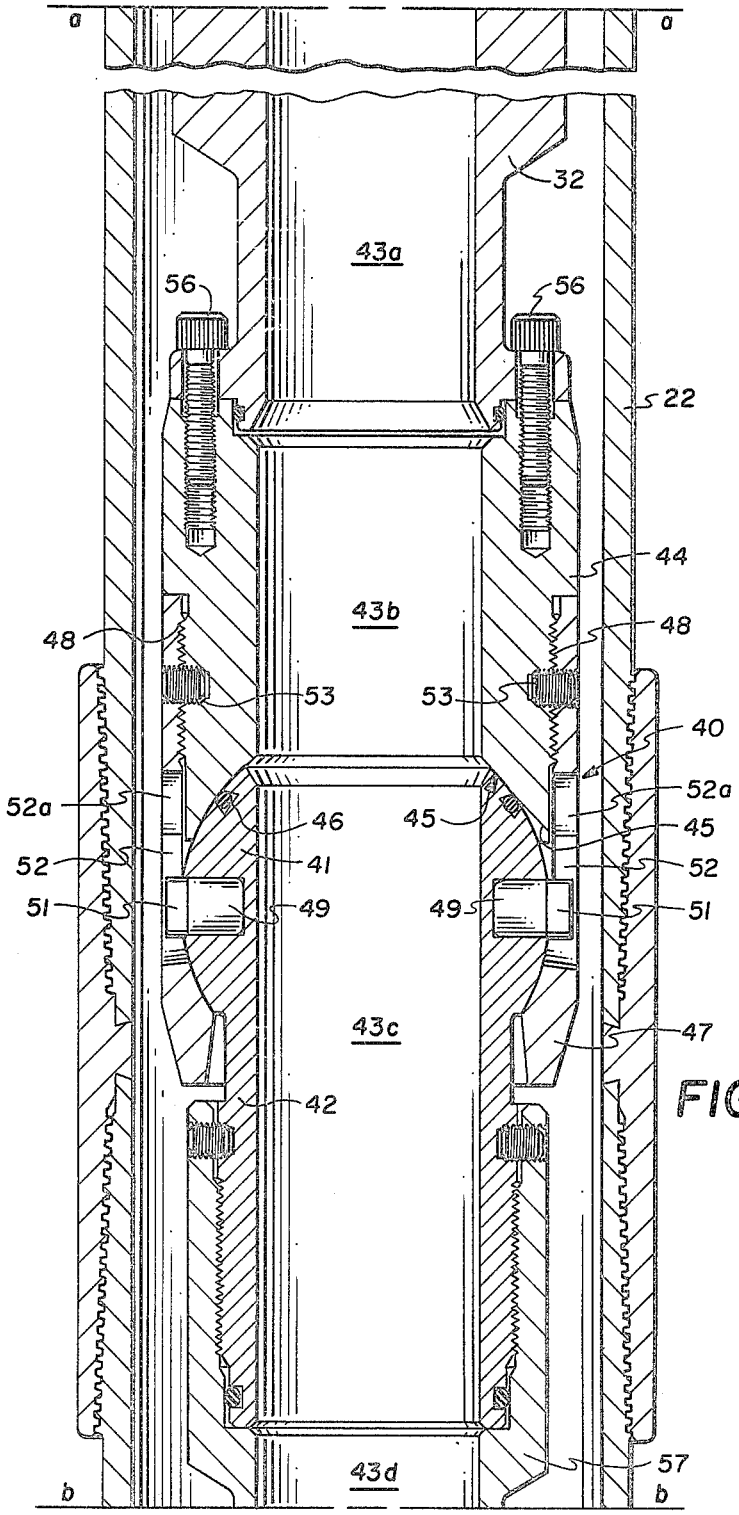
Figure 3C:
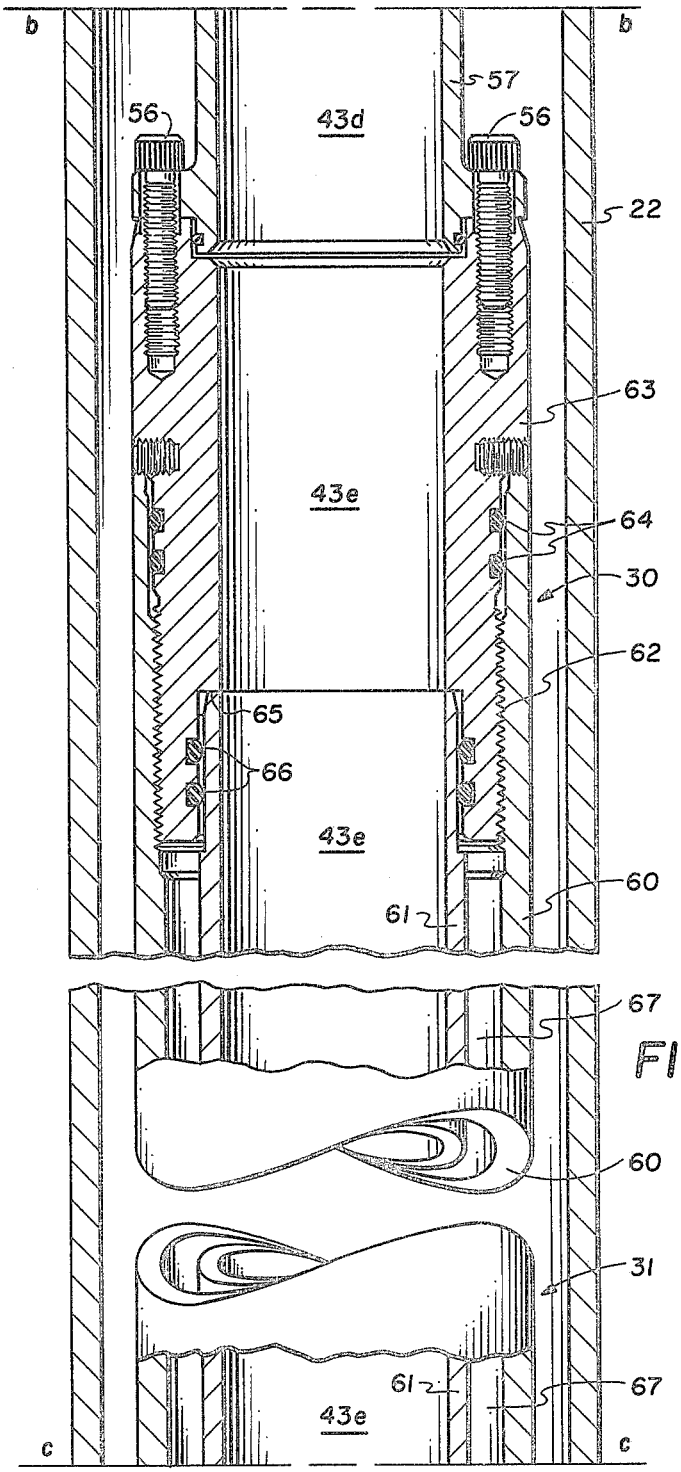
Figure 3D:
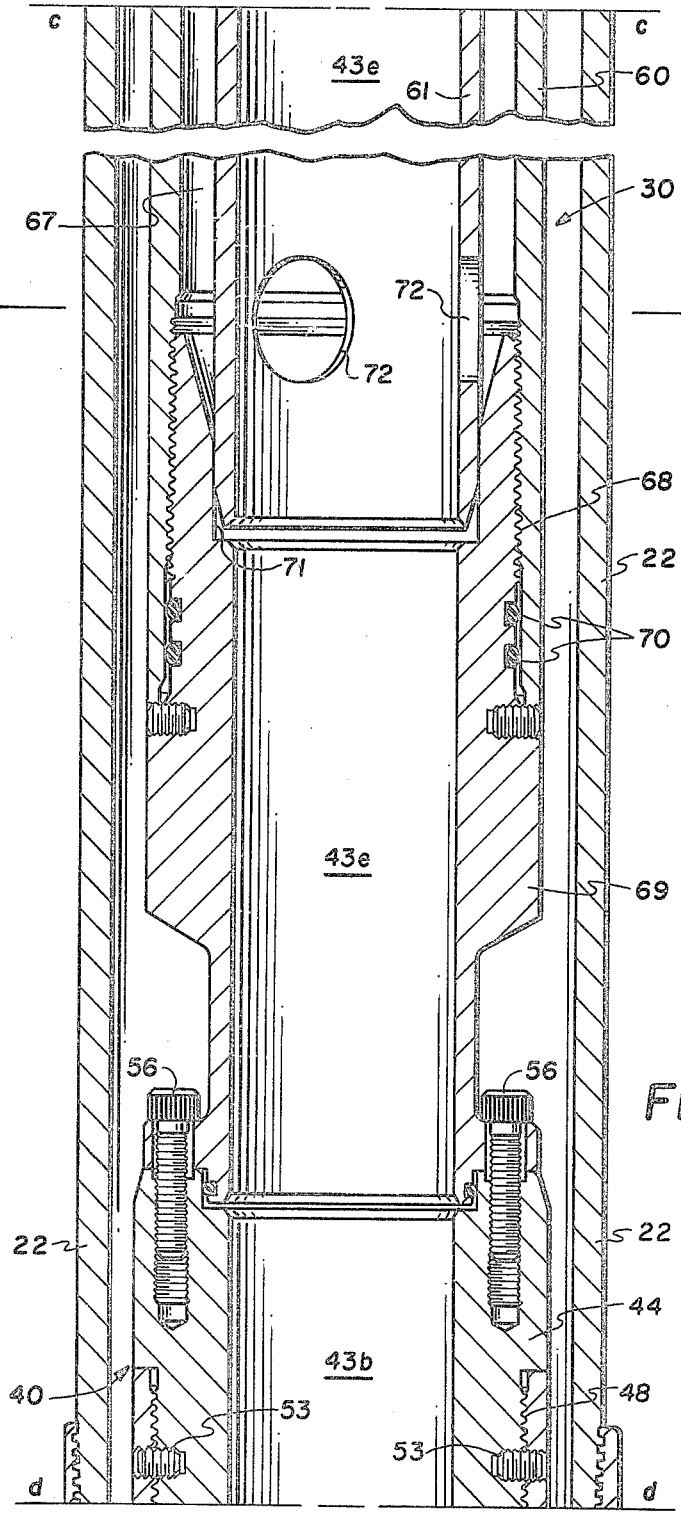
Figure 3E:
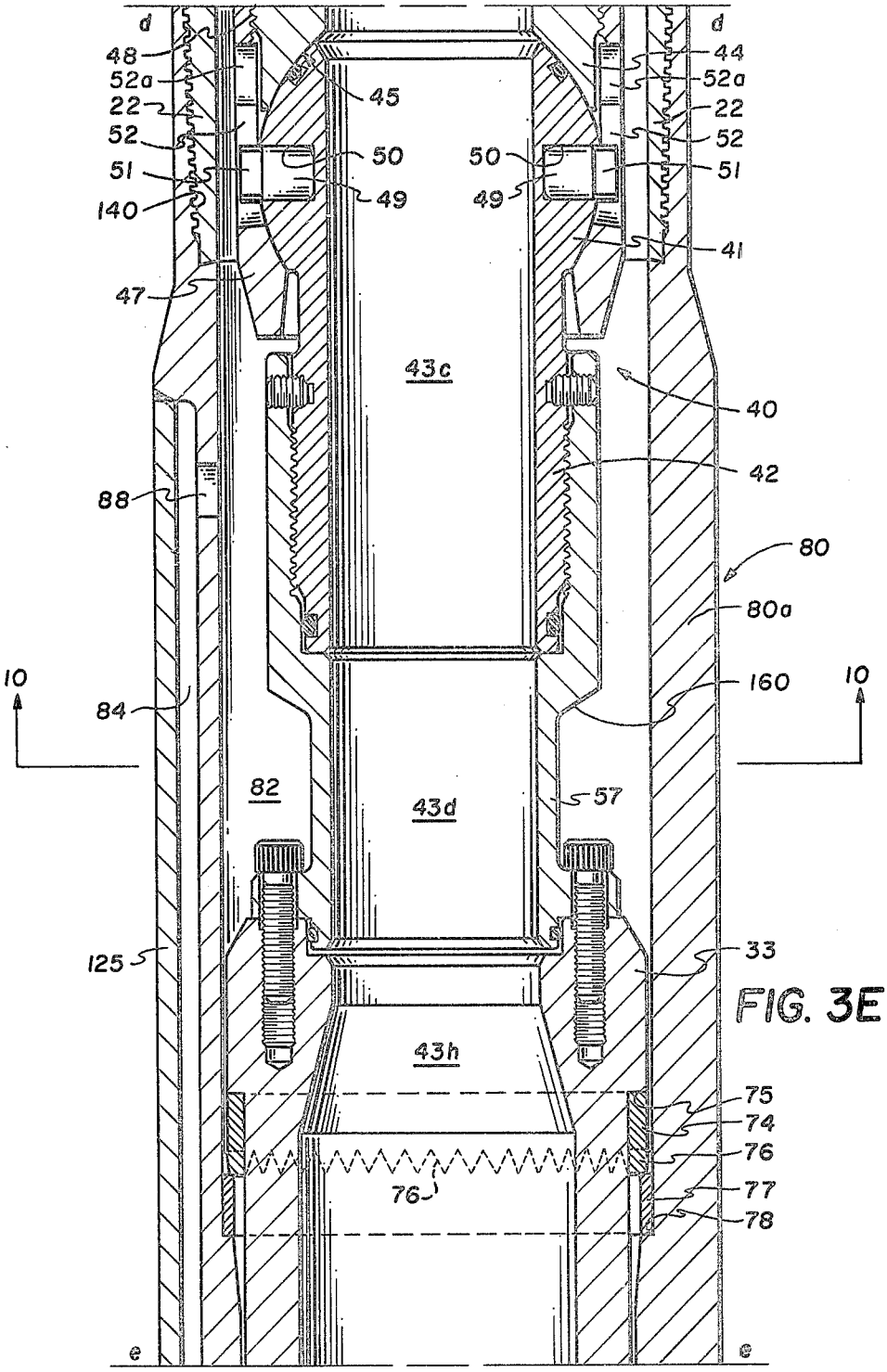
Figure 3F:
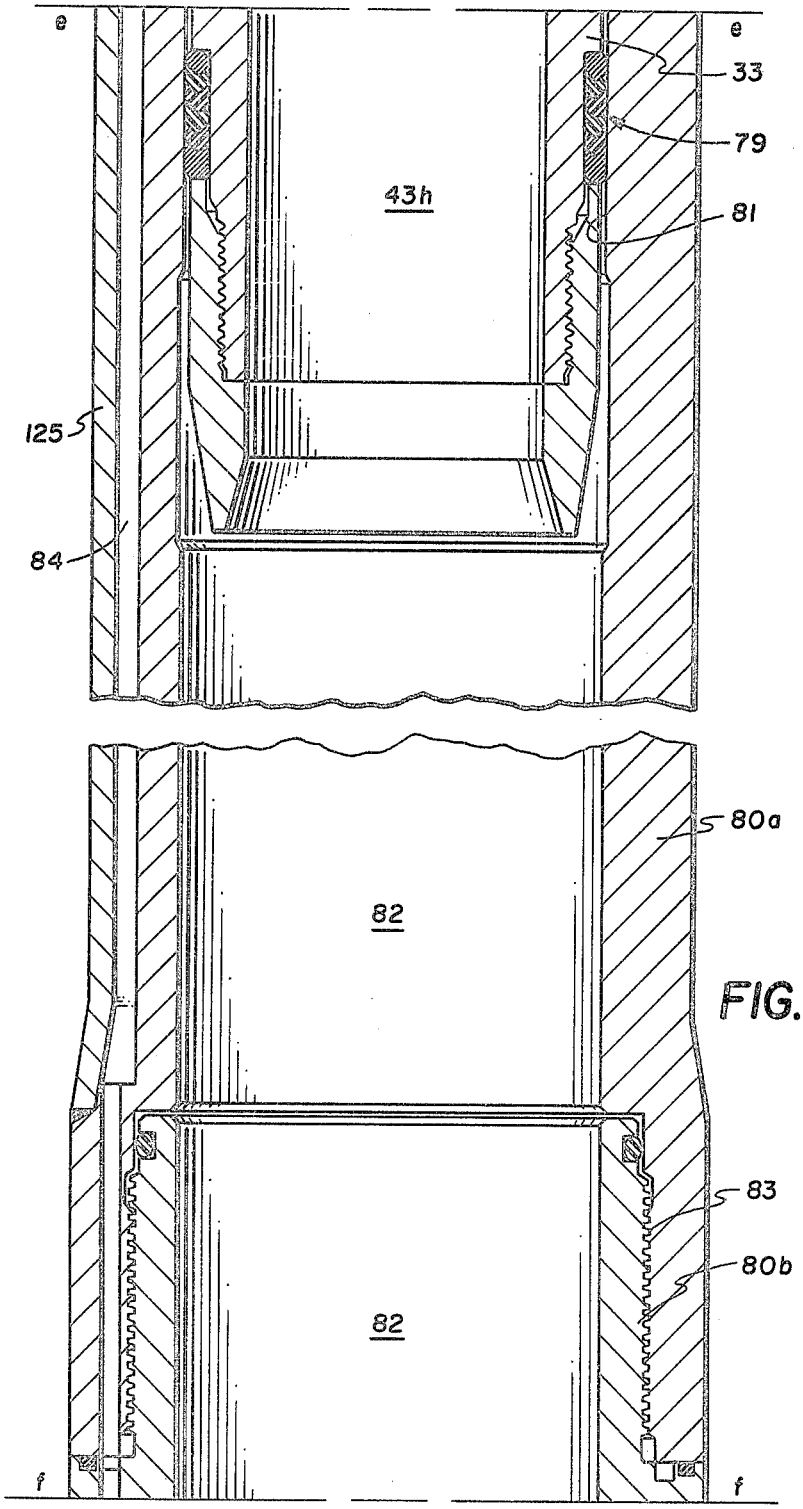
Figure 3G:
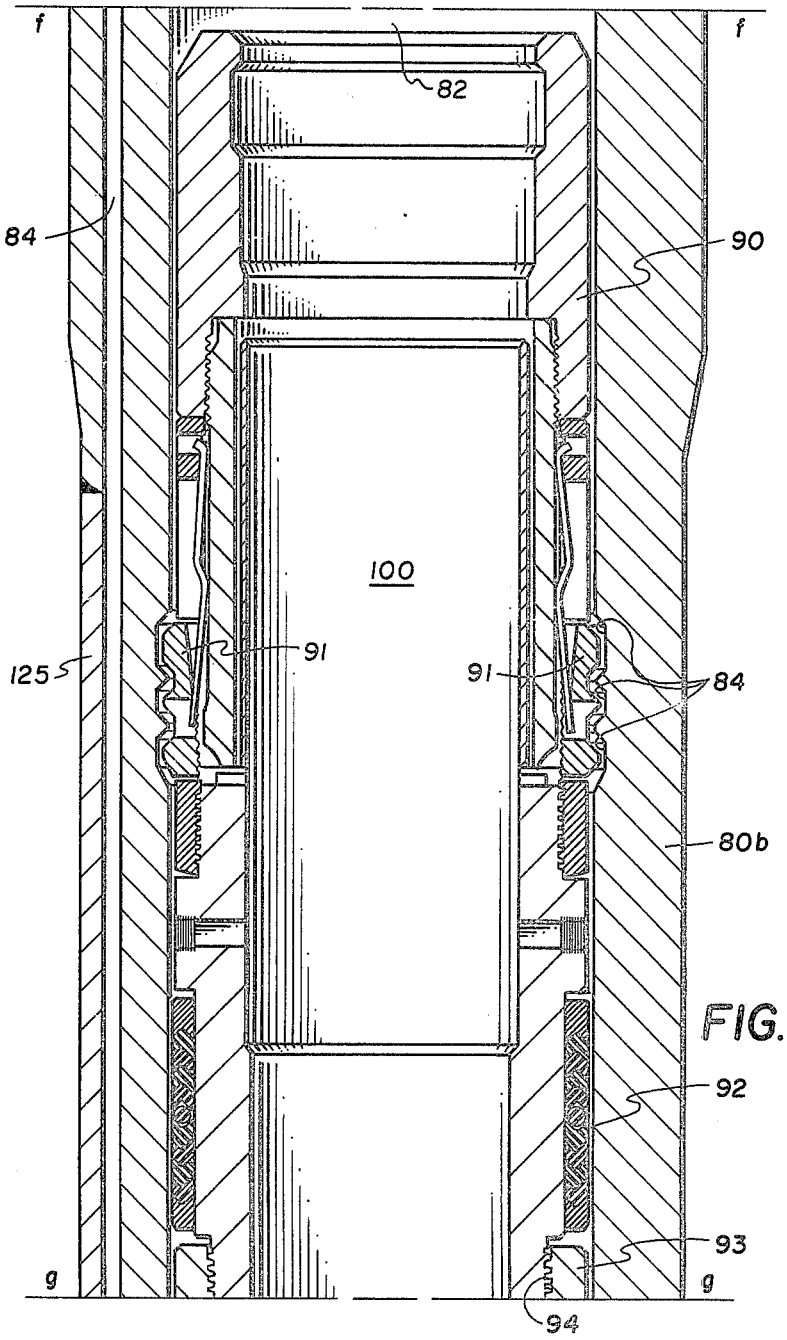
Figure 3H:
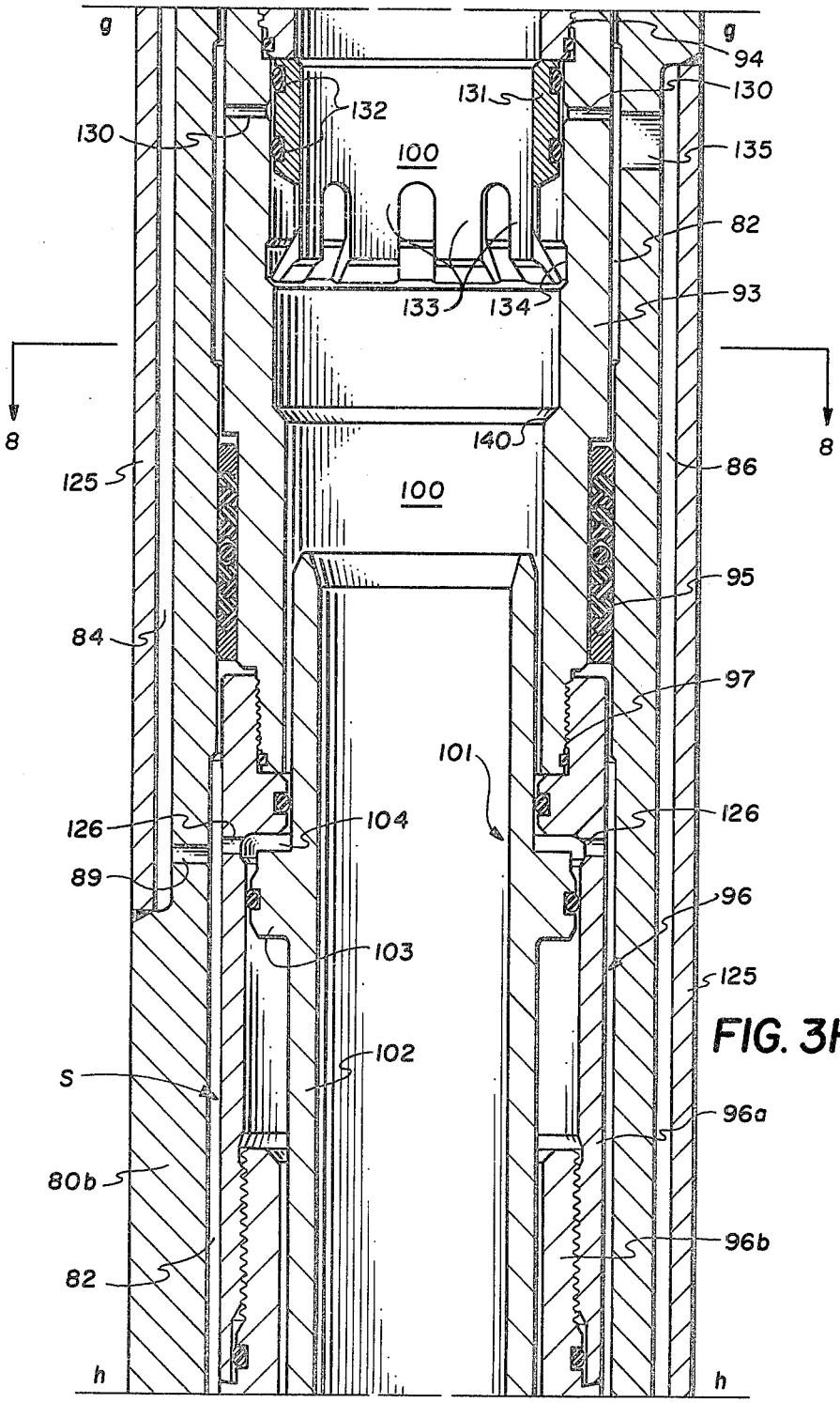
Figure 31:
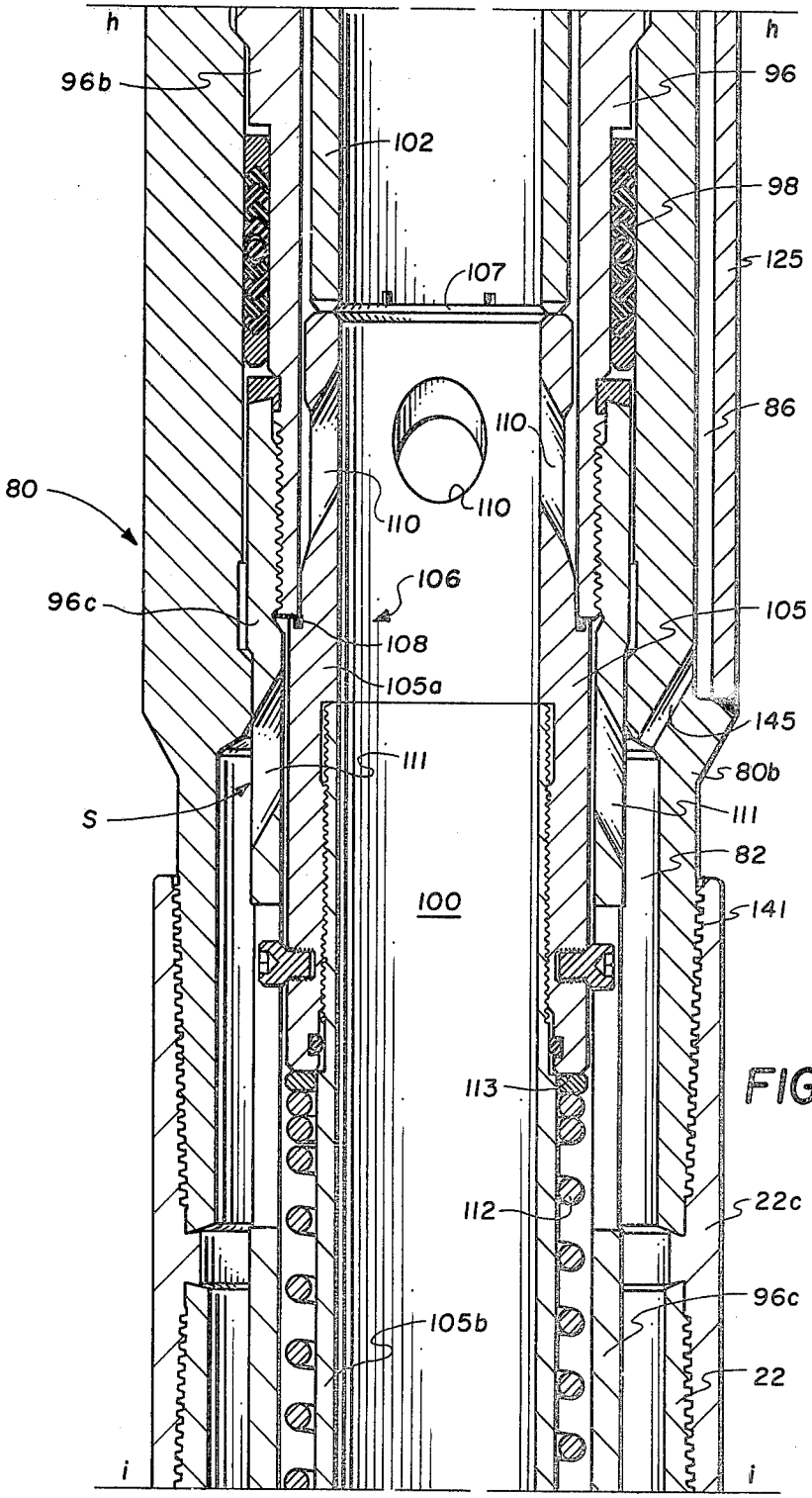
Figure 3J:
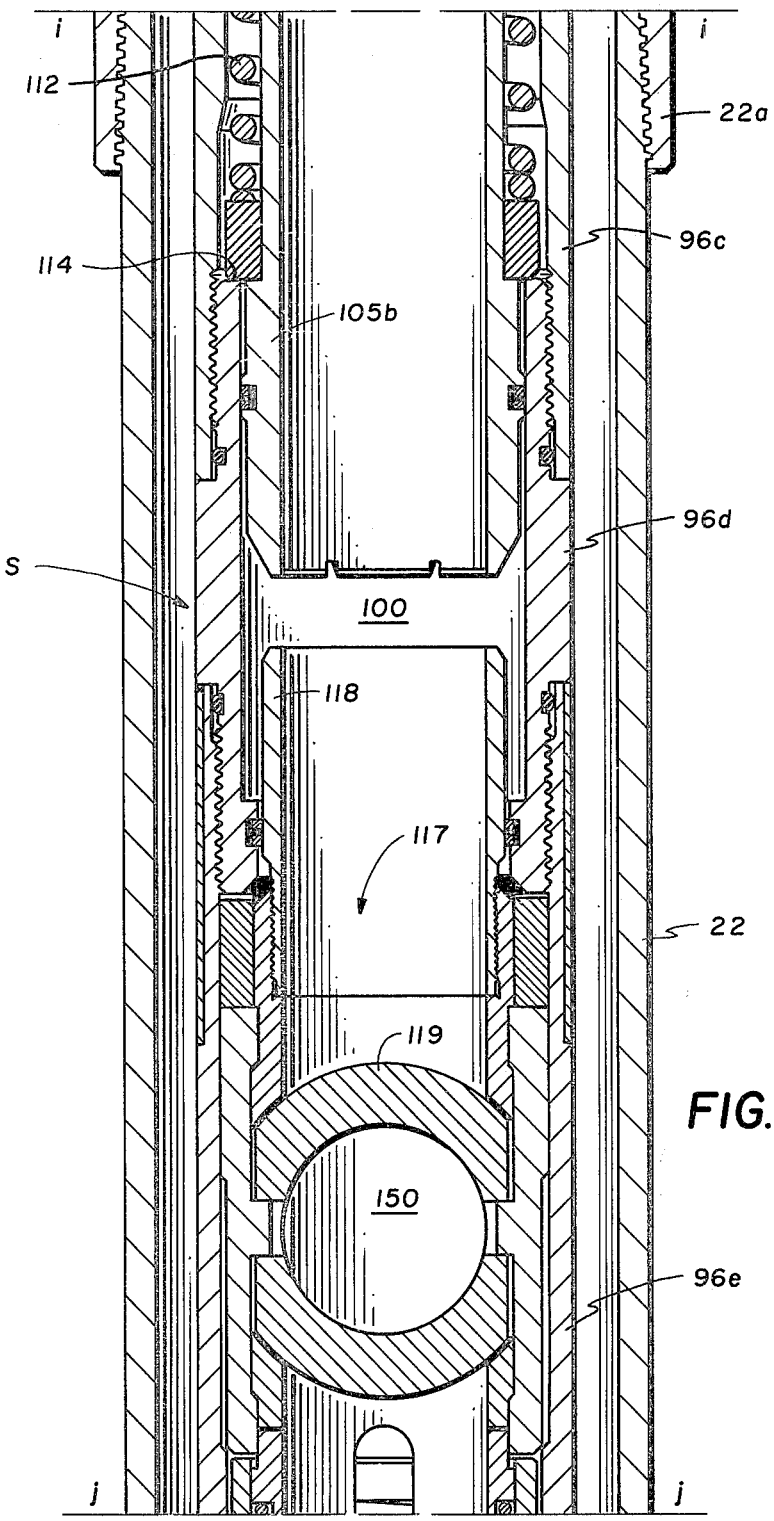
Figure 3K:
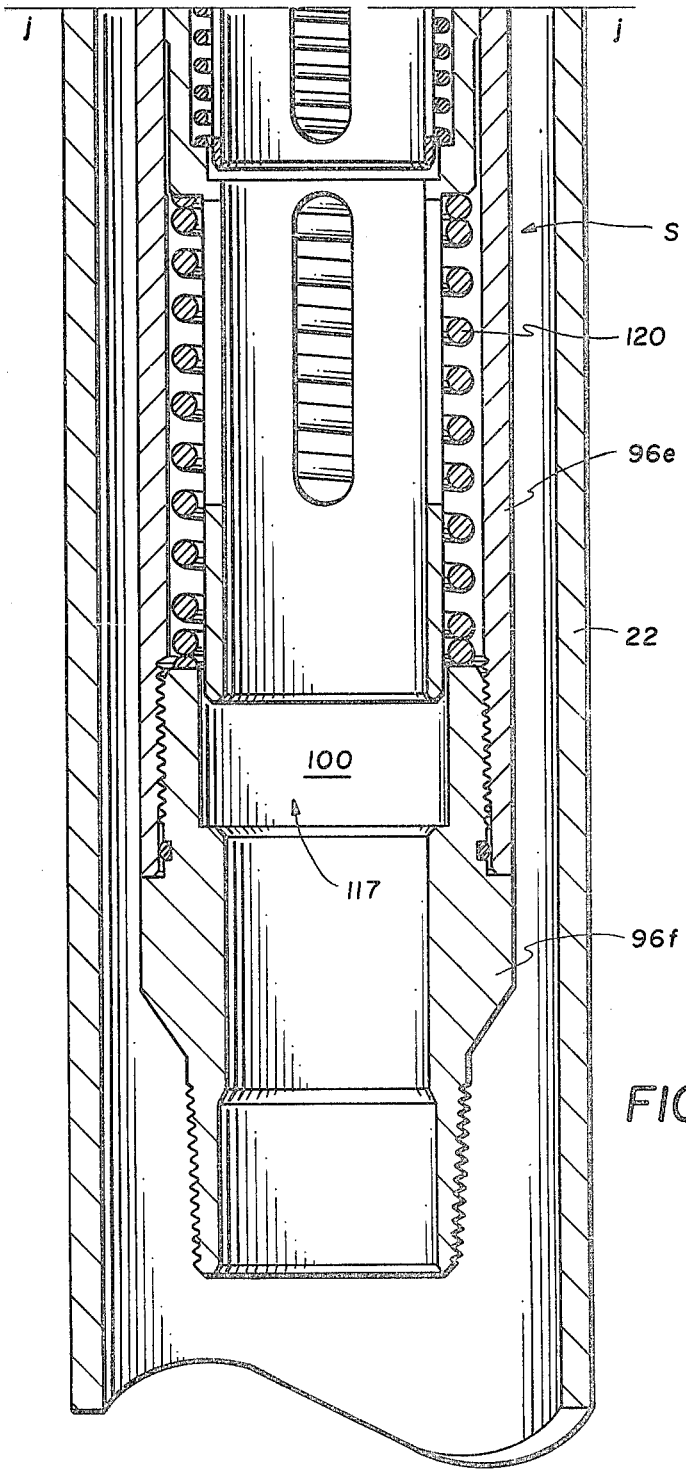

Pump inlet 32 is attached to swivel cap 44 of its associated swivel connector means 40 by bolts 56. Adapter subassembly 57 is used to attach tubular leg 42 to the adjacent accumulator means 30. As shown in FIGS. 3B and 3C, swivel connector means 40 will allow accumulator means 30 and pump inlet 32 to flex relative to each other in one plane as determined by keys 51 and keyways 52. In the same manner, a swivel connector means 40 is preferably installed between each accumulator means 30 and the last accumulator means 30 and seating mandrel 33 as shown in FIGS. 3D and 3E.

When pump P is turned off, safety valve S will close. Accumulator means 30 communicate with pump inlet 32 to supply a reservoir of fluid to allow discharge pressure from pump P to open safety valve S when pump P is turned on. Swivel connector means 40 allows the attachment of as many accumulator means 30 as required for each submersible pump installation. In FIG. 1, two accumulator means 30 are shown. In FIGS. 3C and D only one accumulator means 30 is shown to simplify the description of the invention.

Each accumulator means 30 includes an outer cylinder 60 and an inner cylinder 61. The cylinders are relatively long with cylinder 61 concentrically disposed within cylinder 60. Annulus 67 is formed between cylinder 60 and 61. Bore 43*e* is partially defined by the inside diameter of cylinder 61. The upper end of cylinder 60 is engaged by threads 62 to the exterior of upper end closure 63. Seal means 64 are carried on the exterior of end closure 63 to prevent fluid communication between the interior and the exterior of outer cylinders 60. Inner cylinder 61 abuts shoulder 65 on the inside diameter of end closure 63. Seal means 66 are carried on the inside diameter of end closure 63 to prevent fluid communication at the upper end of accumulator means 30 between annulus 67 and bore 43*e*.

The lower end of cylinder 60 is engaged by thread 68 to the exterior of lower end closure 69. Seal means 70 are carried on the exterior of lower end closure 69 to prevent fluid communication between the interior and the exterior of outer cylinder 60. Inner cylinder 61 is positioned within enlarged inside diameter portion 71 of lower end closure 69. A plurality of openings 72 extend radially through inner cylinder 61 near the lower end thereof. Openings 72 allow fluid commuication between the annulus 67 and bore 43*e*. End closures 63 and 69 hold cylinders 60 and 61 concentrically aligned with each other.

Prior to lowering accumulator means 30 into flow conductor 22, all liquids are removed from annulus 67 and bore 43*e*. Thus, annulus 67 will contain air or an inert gas such as nitrogen if desired. As each accumulator means 30 is lowered through tubing 22, well liquids will enter bore 43 and flow through openings 72 into annulus 67. Seal means 64 and 66 cooperate to prevent the gas within annulus 67 from escaping out of the upper end of accumulator means 30. Thus, as well fluid pressure increases, more liquid will flow through openings 72 to compress the gas in the upper end of annulus 67. This compressed gas is used to discharge the liquid stored in annulus 67 back into bore 43*e* when pump P is started. Bolts 56 are used to attach each end of accumulator means 30 to the adjacent swivel connector means 40.

Seating mandrel 33 is attached to the lower accumulator means 30 by a swivel connector means 40. Seating mandrel 33 is a relatively short hollow cylinder with bore 43*h* extending therethrough. Anti-rotation ring 74 abuts shoulder 75 on the exterior of seating mandrel 33. Ring 74 is preferably shrunk fit to the exterior of seating mandrel 33. Ring 74 has teeth 76 which face downwardly therefrom. A similar anti-rotation ring 77 is shrunk fit into the inside diameter of landing nipple 80 and abuts shoulder 78 therein. Anti-rotation ring 77 has teeth which face upward and are sized to receive teeth 76 on ring 74. Thus, when seating mandrel 33 is lowered into landing nipple 80, the engagement between the teeth on anti-rotation rings 74 and 77 prevents rotation of seating mandrel 33 relative to landing nipple 80. The weight of pump P and the components attached thereto is transferred from shoulder 75 via rings 74 and 77 to shoulder 78.

Packing means 79 are carried on the exterior of seating mandrel 33 below anti-rotation ring 74. Packing means 79 are sized to form a fluid barrier with inside diameter 81 of landing nipple 80. Packing means 79 blocks fluid discharged from ports 29 from flowing downwardly through main bore 82 of landing nipple 80.

Various mechanisms other than anti-rotation rings 74 and 77 could be used to secure seating mandrel 33 within landing nipple 80. U.S. patent application Ser. No. 199,034 filed on Oct. 20, 1980 and U.S. Pat. No. 4,121,659 disclose such mechanisms. Another alternative anti-rotation mechanism (not shown in the drawings) would be to attach one or more bosses to the inside diameter of landing nipple 80 with the bosses projecting into bore 82. Suitable longitudinal slots could be machined partially through seating mandrel 33 to receive the bosses and prevent rotation of seating mandrel 33 relative to landing nipple 80.

Landing nipple 80 is attached by threads 140 and 141 to flow conductor 22 and forms an integral part thereof. For ease of manufacture and assembly, landing nipple 80 has an upper nipple section 80*a* and a lower nipple section 80*b* engaged to each other by threads 83. Bore 82 extends longitudinally through landing nipple 80 and communicates with flow conductor 22. A possible alternative embodiment of the present invention is to modify landing nipple 80 to be a part of casing string 21 and eliminate the use of tubing string 22.

As previously noted, landing nipple 80 carries anti-rotation ring 77 which is part of the means for installing pump P within flow conductor 22. A set of locking grooves 84 is machined in the interior of bore 82 in nipple section 80*b* below shoulder 78 to provide part of the means for installing safety valve S within landing nipple 80. U.S. Pat. No. 3,208,531 to J. W. Tamplen discloses a locking mandrel and running tool which can be used to install safety valve S within landing nipple 80.

Locking mandrel 90 carries dogs 91 which coact with grooves 84 to anchor safety valve S within bore 82. Packing means 92 are carried on the exterior of locking mandrel 90 to form a fluid barrier with the inside diameter of nipple section 80*b* when dogs 91 are secured within grooves 84. Equalizing assembly 93 is attached to locking mandrel 90 by threads 94. Packing means 95 are carried on the exterior of equalizing assembly 93 to form a fluid barrier with the inside diameter of nipple section 80*b*. Packing means 92 and 95 are spaced longitudinally from each other. Valve housing means 96 is engaged by threads 97 to equalizing assembly 93. Packing means 98 are carried on the exterior of housing means 96 to form a fluid barrier with the interior of nipple section 80*b* when dogs 91 are engaged with profile 84.

Safety valve S includes locking mandrel 90, equalizing assembly 93, valve housing means 96 and the valve components disposed therein. Bore 100 extends longitudinally through safety valve S. Packing means 92 and 98 cooperate to direct formation fluid flow through bore 100 and block fluid flow between the exterior of valve S and the interior of nipple 80. When the submersible pump installation is operating normally, formation fluids flow from perforation 35 into pump P via bore 100 in safety valve S, bore 82 in nipple 80 and bore 43 in the components attached to pump P.

Figure 4A:
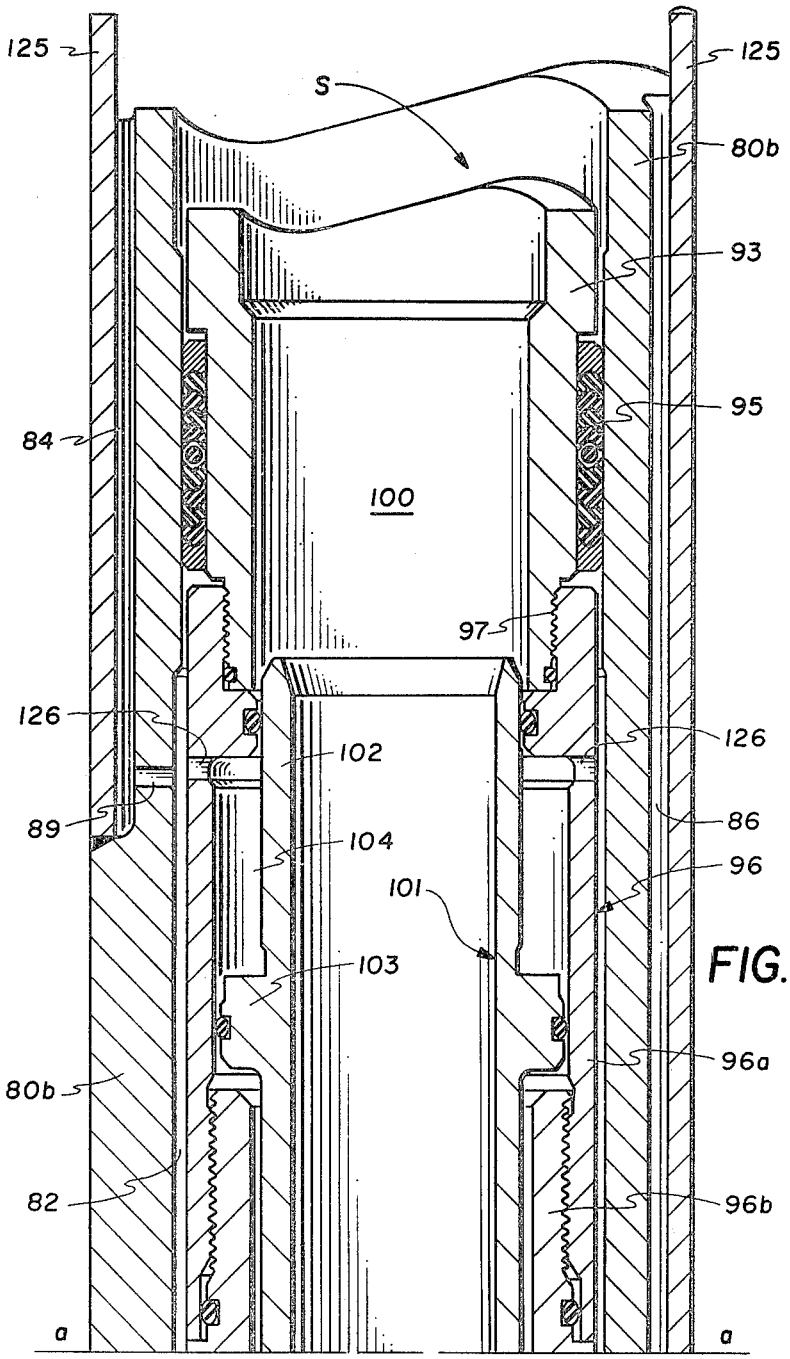
FIGS. 4A–D are drawings in longitudinal section with portions broken away showing the safety system of FIG. 1 in its second or open position allowing fluid flow through the tubing string.
Figure 4B:
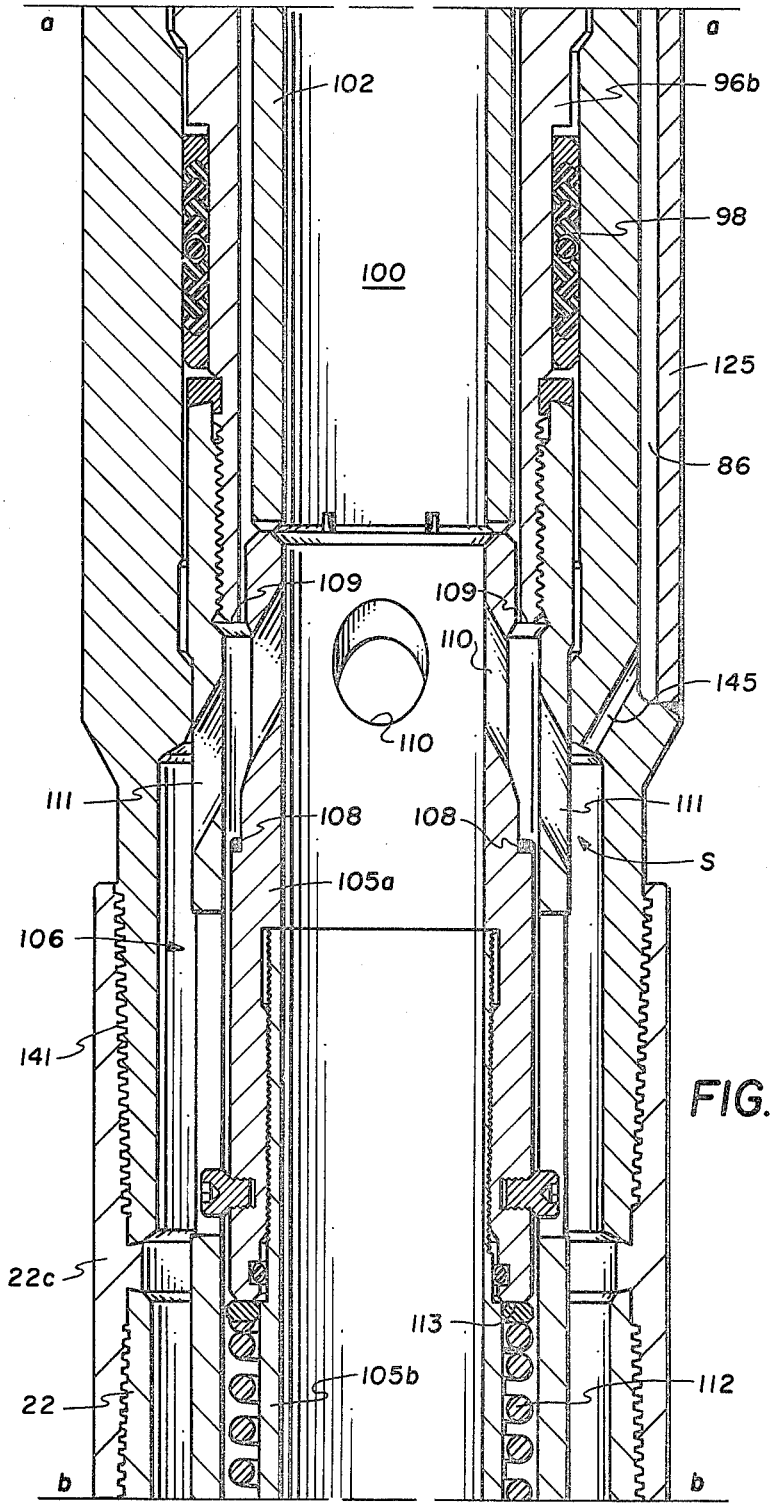

Valve housing means 96 consists of several concentric, hollow sleeves which are connected by threads to each other. Each housing means subassembly has an alphabetic designation. Hydraulically actuated means 101 comprising operating sleeve 102 and piston 103 are slidably disposed within bore 100. Increasing fluid pressure in variable volume chamber 104 will cause operating sleeve 102 to slide longitudinally relative to housing means 96. Inner cylinder 105, which has two subsections designated 105*a* and 105*b*, of poppet valve means 106 abuts the extreme end of operating sleeve 102 at 107. Elastomeric seal 108 is carried on the exterior of inner cylinder 105 intermediate the ends thereof. Metal seating surface 109 is provided on the interior of housing means 96 facing elastomeric seal 108. A plurality of openings 110 extends radially through inner cylinder section 105*a*. Another plurality of openings 111 extends radially through housing subassembly 96*c*. When safety valve S is in its first position as shown in FIG. 3I, elastomeric seal 108 contacts metal seating surface 109 blocking fluid communication through openings 110 and 111. When operating sleeve 102 slides longitudinally in one direction, it will contact inner cylinder 105 and displace elastomeric seal 108 away from metal seating surface 109. This displacement allows fluid communication through openings 110 and 111 as shown in FIG. 4B. Spring 112 disposed between shoulder 113 on the exterior of inner cylinder section 105*b* and shoulder 114 of housing means 96 urges elastomeric seal 108 to contact metal seating surface 109.

Poppet valve means 106 is included within safety valve S because openings 110 and 111 have a large flow area as compared to bore 100. Also, poppet valve means 106 is easily pressure balanced so that less control pressure is required to displace elastomeric seal 108 away from metal seating surface 109 as compared to opening a ball type valve.

Figure 4C:
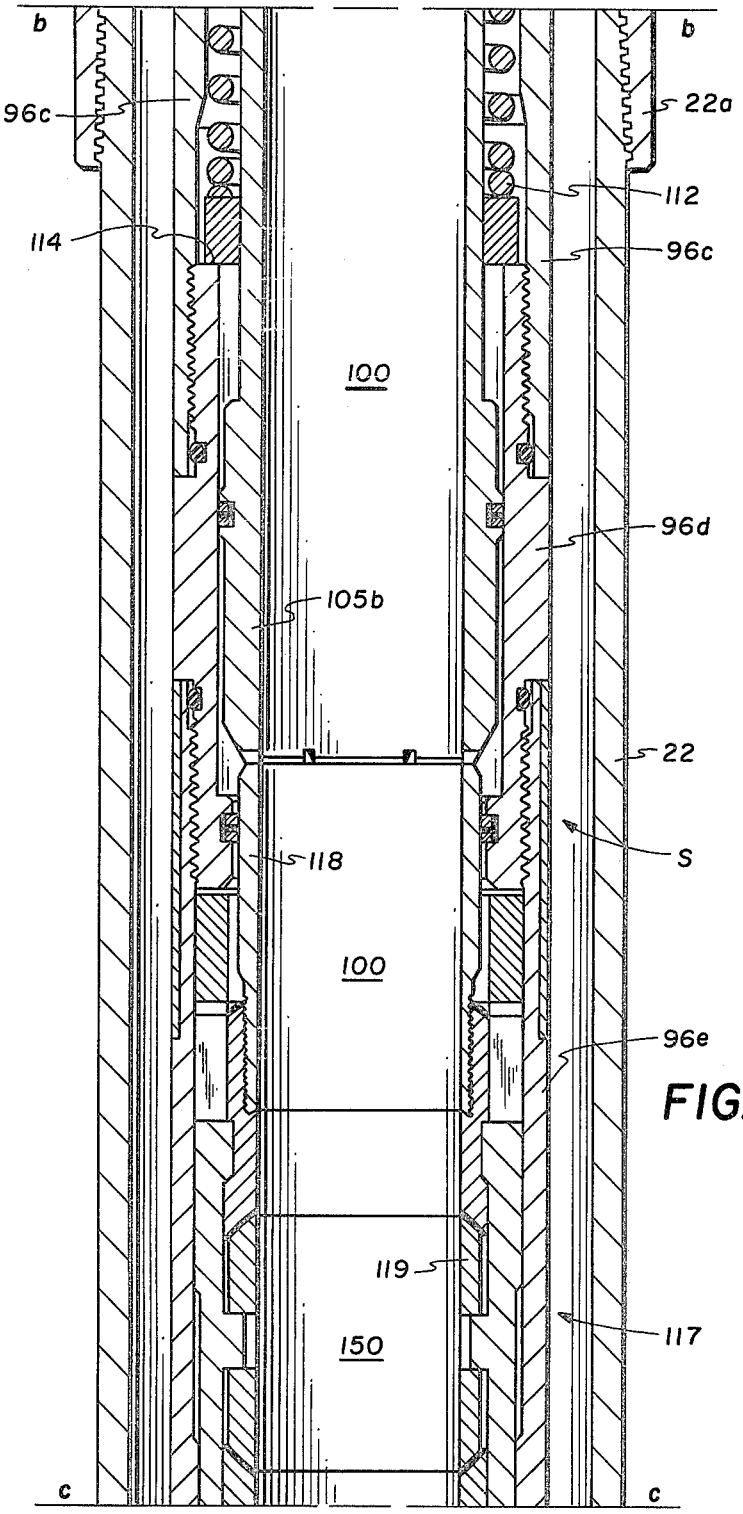
Figure 4D:
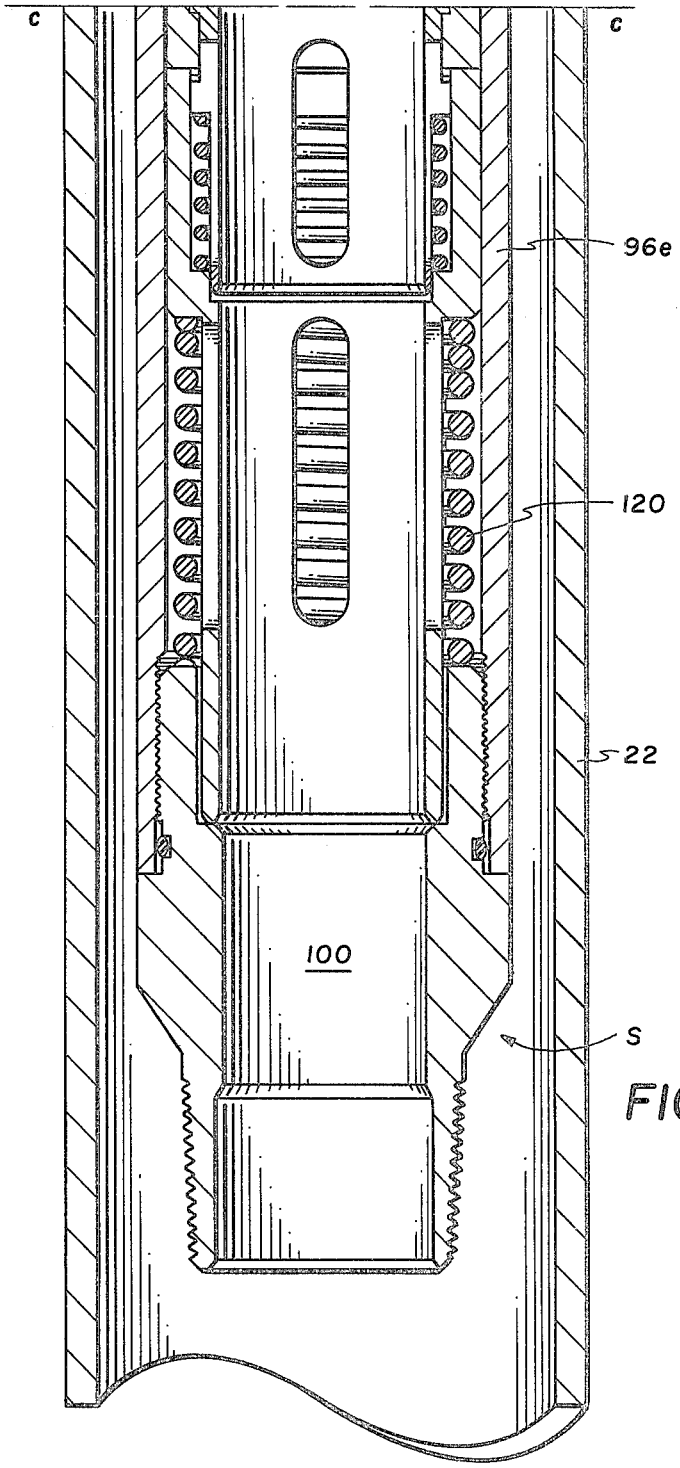

Ball valve means 117 is disposed within safety valve S below poppet valve means 106. Operating sleeve 118 of ball valve means 117 is spaced longitudinally away from inner cylinder section 105*b* when poppet valve means 106 is closed. When piston means 103 shifts poppet valve means 106 to its open position, inner cylinder section 105*b* will contact operating sleeve 118 to rotate ball 119 to align bore 150 of ball 119 with bore 100 as shown in FIG. 4C. Ball valve means 117 is open when bore 150 is aligned with bore 100. Ball valve means 117 is shut when bore 150 is rotated normal to bore 100. Spring 120 urges ball 119 to rotate to block bore 100 when fluid pressure is released from piston means 103.

Ball valve means 117 is a normally closed safety valve which is opened by inner cylinder section 105*b* of poppet valve means 106 contacting operating sleeve 118. Both poppet valve means 106 and ball valve means 117 operate in substantially the same manner as other surface controlled subsurface safety valves. Control fluid pressure is applied to piston means 103 to shift safety valve S to its second or open position. When control fluid pressure is released from piston means 103, springs 112 and 120 cooperate to return safety valve S to its first or closed position blocking fluid flow through bore 100. As will be explained later, control fluid pressure to piston means 103 is supplied from the discharge of pump P.

Since inner cylinder section 105*b* is spaced longitudinally from operating sleeve 118 when safety valve S is in its first position, poppet valve means 106 will open first when pump P is started. Well fluids will initially flow into bore 100 through openings 110 and 111 to equalize any pressure difference across ball 119 and to supply well fluids to pump inlet 32. Thus, accumulator means 30 must contain at least enough fluid to open poppet valve means 106. Also, equalizing the pressure difference across ball 119 prior to rotating ball 119 significantly reduces the force required to open ball valve means 117 and minimizes the possibility of damage to safety valve S. If desired, a flapper valve could be substituted for ball valve means 117. Co-pending U.S. patent application Ser. No. 186,980 filed on Sept. 15, 1980 fully explains the operation of safety valve S.

Landing nipple 80 directs a portion of the fluid discharged from pump P to variable volume chamber 104 via longitudinal flow passageways 84 and 85. Longitudinal flow passageways 84 and 85 are formed by machining longitudinal grooves partially into the exterior of landing nipple 80. Radial ports 88 extend through nipple 80 near the upper end of passageways 84 and 85 to communicate fluids between bore 82 and passageways 84 and 85. Ports 88 are positioned above the point at which packing means 79 forms a fluid barrier with inside diameter 81 of landing nipple 80. Thus, a portion of the fluid discharged from pump P can flow from pump discharge 29 to longitudinal flow passageways 84 and 85 via bore 82 and ports 88. Rods 125 are partially inserted into each longitudinal groove and are welded to landing nipple 80 to provide a fluid barrier between longitudinal flow passageways 84 and 85 and the exterior of nipple 80. This method of constructing flow passageways 84 and 85 results in a relatively uniform outside diameter and minimizes the possibility of mechanical damage which could block control fluid flow to safety valve S.

Radial port 89 extends through nipple 80 near the lower end of each longitudinal flow passageway 84 and 85. Ports 89 are positioned to communicate fluid with bore 82 between packing means 95 and 98 on the exterior of safety valve S. A plurality of ports 126 extends from variable volume chamber 104 through valve housing means 96 adjacent to radial ports 89. The longitudinal flow passageways 84 and 85 comprise a portion of the means for conducting fluid pressure from pump discharge outlets 29 to hydraulically actuated means 101 to open safety valve S.

From studying the previous description and related drawings, it is readily apparent that the present invention allows a wide variety of subsurface safety valves to be used with the submersible pump installation. The minimum dimensional requirement for selecting an alternative safety valve is that when the valve is attached to threads 94 of locking mandrel 90, packing means must be positioned on opposite sides of radial ports 89 to direct control fluid flow to the safety valve's hydraulically actuated means. The minimum operational requirement for the alternative valve is that the relatively low discharge pressure from pump P can open the safety valve.

Equalizing assembly 93 is positioned within safety valve S between locking mandrel 90 and valve housing means 96. Equalizing assembly 93 provides means for selectively equalizing fluid pressure between bore 100 and the exterior of safety valve S while installing and removing safety valve S from bore 82 of landing nipple 80. A plurality of aperture 130 extend radially through equalizing assembly 93. Sliding sleeve 131 with a pair of o-ring seals 132 carried on its exterior is disposed within equalizing assembly 93. O-ring seals 132 are spaced from each other so that when sleeve 131 is in its first or upper position, o-ring seals 132 will straddle apertures 130 blocking fluid flow therethrough. Collet fingers 133 are carried by sleeve 131 to engage groove 134 and hold sleeve 131 in its first position. Various wireline tools are commercially available which can be lowered from the well surface through tubing 22, after pump P has been removed, to shift sleeve 131 to either open or block apertures 130.

Longitudinal flow passageways 86 and 87 are provided in the exterior of landing nipple 80 to communicate well fluids from below landing nipple 80 to equalizing assembly 93. Radial ports 135 extend from bore 82 through nipple 80 to the upper end of longitudinal flow passageways 86 and 87. Radial ports 135 are positioned adjacent to apertures 130 between packing means 92 and 95. Therefore, control fluid or pump discharge fluid is blocked by packing means 95 from communicating with longitudinal flow passageways 86 and 87. Rods 125 are used to seal longitudinal flow passageways 86 and 87 in the same manner as previously described for longitudinal flow passageways 84 and 85. The lower end of longitudinal flow passageways 86 and 87 communicates with bore 82 below packing means 98 through openings 145.

OPERATING SEQUENCE

Landing nipple 80 is installed within tubing 22 at the preselected downhole location using conventional well completion techniques. Safety valve S is lowered through tubing string 22 with equalizing assembly 93 open until locking mandrel 90 is engaged with locking grooves 84. Equalizing assembly 93 is then shut. Safety valve S would be in its first position blocking fluid flow from perforations 35 to the well surface via tubing 22. Spring 112 holds poppet valve means 106 shut, and spring 120 holds ball valve means 117 shut. Pump P and the components attached thereto can then be lowered through tubing 22 until seating mandrel 33 engages landing nipple 80 above safety valve S. When pump P is turned on, the liquid contained in accumulator means 30 is discharged from pump P to variable volume chamber 104 via longitudinal flow passageways 84 and 85 to open safety valve S. Poppet valve means 106 will open first to increase the supply of liquids to pump inlet 32. Continued operation of pump P will cause further movement of inner cylinder 105 of poppet valve means 106 until ball valve means 117 is opened. At this time, well fluids will flow from perforations 35 into bore 100 via ball 119 and openings 110 and 111. From bore 100 well fluids will flow through bores 82 and 43 into pump inlet 32 and be discharged from outlets 29 to the well surface. The discharge pressure of pump P is applied to variable volume chamber 104 to hold safety valve S open as long as pump P is operating. When pump P is turned off, springs 112 and 120 cooperate to return safety valve S to its first or closed position. Pump P and the components attached thereto may be safely removed from tubing 22 when safety valve S is in its first position.

The previous description illustrates only one embodiment of the present invention. Alternative embodiments will be readily apparent to those skilled in the art without departing from the scope of the invention which is defined by the claims.

What is claimed is:

1. A safety system for a submersible pump, having an intake and a discharge, disposed within a well flow conductor comprising:

a. means for installing the pump within the flow conductor at a preselected downhole location and for forming a fluid seal with the interior of the flow conductor to direct fluid flow through the pump;

b. means for installing a subsurface safety valve within the flow conductor at the preselected downhole location below the submersible pump and for forming a fluid seal between the exterior of the safety valve and the interior of the flow conductor;

c. the safety valve having hydraulically actuated means for opening and closing the safety valve;

d. a landing nipple with a longitudinal bore therethrough comprising a portion of the flow conductor at the preselected downhole location;

e. the landing nipple comprising a portion of the means for installing the submersible pump and the safety valve within the flow conductor;

f. a longitudinal flow passageway extending partially through the landing nipple and communicating with the longitudinal bore at preselected locations; and g. the longitudinal flow passageway comprising means for conducting fluid pressure from the pump discharge to the hydraulically actuated means to open the safety valve.

2. A safety system as defined in claim 1 further comprising:

a. accumulator means attached to the submersible pump for supplying fluid to the pump intake; and b. the capacity of the accumulator means selected to provide sufficient fluid to open the safety valve when the pump is started.

3. A safety system as defined in claim 2 further comprising:

a. the accumulator means positioned between the submersible pump and the means for installing the submersible pump within the flow conductor;

b. swivel connector means for attaching the accumulator means to the pump intake; and c. means for transmitting torque from the submersible pump through the swivel connector means to the installing means whereby the submersible pump is prevented from rotating with respect to the flow conductor.

4. A safety system as defined in claim 3 wherein the swivel connector means further comprises:

a. a ball member having a tubular leg extending therefrom and a bore extending longitudinally through the ball member and tubular leg;

b. the ball member having a generally spherical exterior surface with a pair of keys extending radially therefrom on opposite sides of the ball member;

c. a swivel cap having a bore in communication with the bore through the ball member and a first sealing surface engaging the ball member;

d. a housing means around the ball member and holding the swivel cap engaged with the ball member and the tubular leg extending through the housing means; and e. a pair of keyways formed radially opposite from each other in the housing means to receive the keys which prevent rotation of the ball member relative to the housing means.

5. A safety system as defined in claim 2 wherein the means for installing the pump within the flow conductor further comprises:

a. a seating mandrel attached to the accumulator means with a longitudinal bore therethrough;

b. shoulder means carried on the exterior of the seating mandrel for engagement with a matching shoulder means on the interior of the landing nipple;

c. the sealing means carried on the exterior of the seating mandrel; and d. the shoulder means engaging each other to prevent rotation of the seating mandrel relative to the landing nipple.

6. A safety system as defined in claim 1 further comprising:

a. means for selectively equalizing fluid pressure between the interior and the exterior of the safety valve while installing and removing the safety valve from the longitudinal bore of the landing nipple; and b. at least one of the longitudinal flow passageways communicating well fluids from below the landing nipple to the equalizing means.

7. A safety system as defined in claim 1 having a plurality of longitudinal flow passageways in the landing nipple which further comprise:

a. longitudinal grooves formed in the exterior of the landing nipple;
b. radial ports extending through the landingg nipple at the preselected locations to allow fluid communication between the grooves and the longitudinal bore of the landing nipple;
c. a rod extending the length of each groove and partially into its respective groove; and
d. the rods welded to the landing nipple to provide a fluid barrier between the longitudinal grooves and the exterior of the landing nipple.

8. A landing nipple for releasably installing a submersible pump and a safety valve at a downhole location within a well flow conductor comprising:
a. a longitudinal bore through the landing nipple which comprises a portion of the flow conductor;
b. a longitudinal flow passageway extending partially through the landing nipple and communicating with the longitudinal bore at preselected locations;
c. the longitudinal flow passageway comprising means for conducting fluid pressure from the pump discharge to open the safety valve; and
d. means for releasably installing the submersible pump within the longitudinal bore to prevent rotation of the pump relative to the landing nipple.

9. A landing nipple as defined in claim 8 wherein the landing nipple has a plurality of longitudinal flow passageways further comprising:
a. longitudinal grooves formed in the exterior of the landing nipple;
b. radial ports extending through the landing nipple at the preselected locations to allow fluid communication between the grooves and the longitudinal bore of the landing nipple;
c. a rod extending the length of each groove and partially into its respective groove; and
d. the rods welded to the landing nipple to provide a fluid barrier between the longitudinal grooves and the exterior of the landing nipple.

10. A well completion which includes a submersible pump with an inlet and discharge disposed within a flow conductor and a safety system for controlling fluid flow through the flow conductor comprising:
a. means for installing the pump within the flow conductor at a preselected downhole location and for forming a fluid seal with the interior of the flow conductor to direct fluid flow through the pump;
b. means for installing a subsurface safety valve within the flow conductor at the preselected downhole location below the submersible pump and for forming a fluid seal between the exterior of the safety valve and the interior of the flow conductor;
c. the safety valve having hydraulically actuated means for opening and closing the safety valve;
d. an accumulator means attached to the submersible pump for supplying fluid to the pump inlet;
e. a seating mandrel attached to the accumulator means with a longitudinal bore therethrough;
f. swivel connector means for attaching the accumulator means to the pump inlet and adjacent accumulator means; and
g. means for transmitting torque from the submersible pump through the swivel connector means to the installing means whereby the submersible pump is prevented from rotating with respect to the flow conductor.

11. A well completion as defined in claim 10 wherein the swivel connector means further comprises:
a. a ball member having a tubular leg extending therefrom and a bore extending longitudinally through the ball member and tubular leg;
b. the ball member having a generally spherical exterior surface with a pair of keys extending radially therefrom on opposite sides of the ball member;
c. a swivel cap having a bore in communication with the bore through the ball member and a first sealing surface engaging the ball member;
d. a housing means around the ball member and holding the swivel cap engaged with the ball member and the tubular leg extending through the housing means; and
e. a pair of keyways formed radially opposite from each other in the housing means to receive the keys which prevent rotation of the ball member relative to the housing means.

12. A swivel connector for use in a submersible pump installation within a well flow conductor comprising:
a. a ball member having a tubular leg extending therefrom and a bore extending longitudinally through the ball member and tubular leg;
b. the ball member having a generally sperical exterior surface with a pair of lugs positioned in holes on opposite sides thereof and a portion of each lug extending radially from the ball member;
c. a key formed on the portion of each lug extending from the ball member;
d. a swivel cap having a bore in communication with the bore through the ball member and a first sealing surface engaging the ball member;
e. a housing means around the ball member and holding the swivel cap engaged with the ball member and the tubular leg extending through the housing means;
f. a pair of keyways formed radially opposite from each other in the housing means to receive the keys which prevent rotation of the ball member relative to the housing means; and
g. a circular opening at the end of each keyway to allow insertion of its respective lug therethrough and into its respective hole in the ball member.

* * * * *